United States Patent [19]

Cheng

[11] Patent Number: 4,932,890

[45] Date of Patent: Jun. 12, 1990

[54] CONNECTION BOX FOR DECORATION LIGHTING STRINGS

[76] Inventor: Horng-Huei Cheng, No. 3, Lane 320, Sec. 5, Chung-Hwa Rd., Hsin-Chu City, Taiwan

[21] Appl. No.: 296,087

[22] Filed: Jan. 11, 1989

[51] Int. Cl.[5] ..... H01R 13/639

[52] U.S. Cl. ..... 439/367; 439/289; 439/369; 439/752

[58] Field of Search ..... 439/284, 287, 289, 292, 439/367–370, 731, 752

[56] References Cited

U.S. PATENT DOCUMENTS 2,760,173 8/1956 Cunningham ..... 439/368

4,184,734 1/1980 Toorell ..... 439/731 X

*Primary Examiner*—Steven C. Bishop

*Attorney, Agent, or Firm*—Bucknam and Archer

[57] ABSTRACT

A connection box for the connection of two short strings of decoration lights into a long one, comprises an elongated tray body with U shaped cross-section and having longitudinal channels provided therein for the conductors of the light strings entering from respective end to be connected. Piers and ribs are disposed within the tray to ensure the gripping of the connection conductors. A cover with catch means is provided on top of the tray.

7 Claims, 3 Drawing Sheets

CONNECTION BOX FOR DECORATION LIGHTING STRINGS

The present invention relates generally to a connection box and more particularly to a connection box for electrical connection of two short strings of decoration lights into a long one.

In the field of manufacturing of decoration lights, such as Christmas light strings, a long string of say, one hundred lights and longer are usually called for. Such a long string often causes trouble both in manufacturing as well as in packing and transportation. Of course a long string resulting from the connection of at least two strings of shorter length can solve the problem. However, the lack of a readily provided connection box has not made such idea practical.

Therefore, the main object of the present invention is to provide a connection box for use in the connection of two shorter strings of decoration lights into a longer one. The box comprises generally a body of an elongated tray having a U shaped cross-section, and a cover is provided at the top. A downwardly disposed hook at each end under the cover serves to catch and hold a recess located at corresponding position of the tray bottom. The tray is open ended to enable the passage of the conductors of the light strings to be connected inside the box body. Mainly, each box serves for the connection of two elementary strings, and with the addition of a further box, the string may be extended to a new length until it reached the final length. In other words, the number of elementary strings in the final length containing n boxes shall be $n+1$. Theoretically, n can be of no limit.

Another object of the present invention is to provide a body of a tray of a connection box with piers and blocks which constitute the channels for the communication of conductors of the strings to be connected via engagement of terminals provided at each end of the conductor.

Still another object of the present invention is to provide ribs to restrict the motion of the end conductors so that the contact connected conductors are not pulled to become loose when subjected to foreign forces.

Other objects and features of the present invention will become apparent through the following description in conjunction with the annexed drawings, of which:

Figure 2:
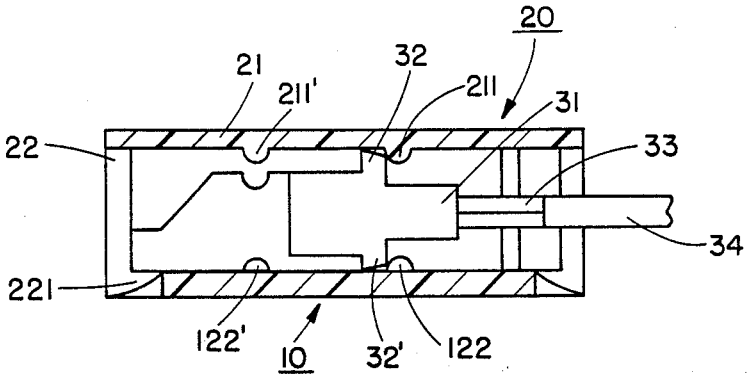
FIG. 2 is a front view of the longitudinal section along line II—II in FIG. 3, a top view of the embodiments.
Figure 1:
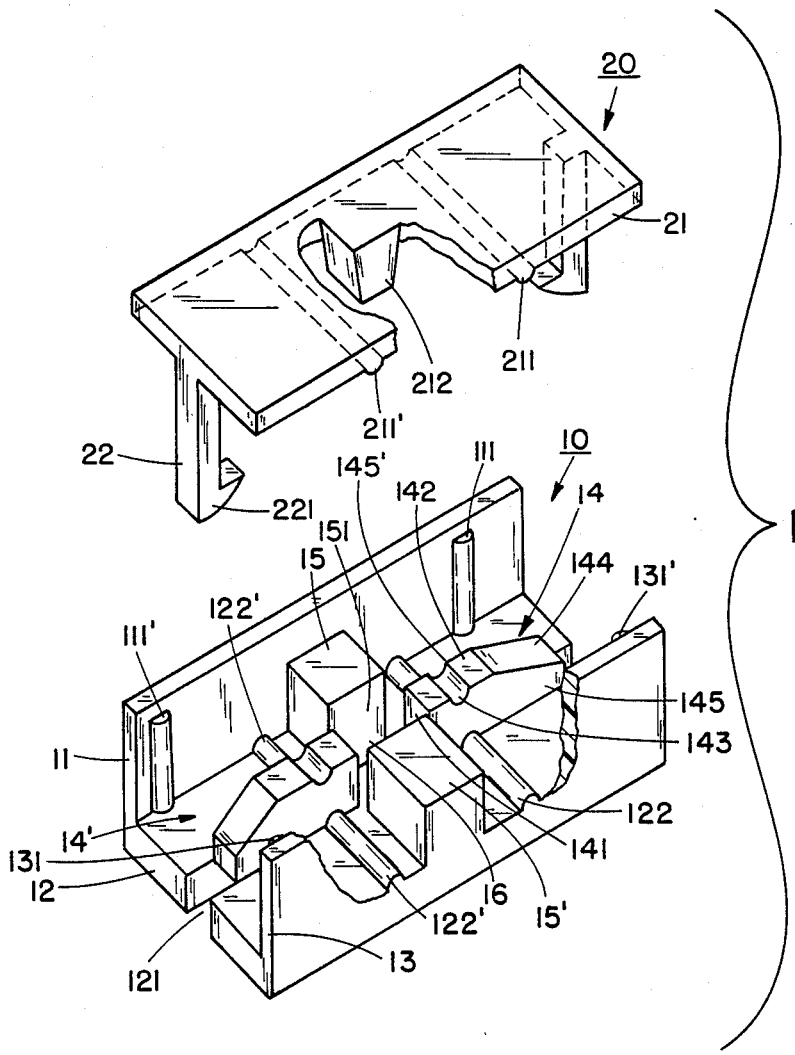
FIG. 1 is an exploded perspective view of a preferred embodiment of the connection box of the present invention.

Now referring to FIGS. 1 and 2, the connection box of the present invention comprises mainly a body 10 and a cover 20. The body 10 is formed like a tray having a U-shaped cross-section with two vertical walls 11, 13 and a horizontal bottom 12 which joins the vertical walls. At each end of the bottom 12, a recess 121 is disposed to serve as a catcher to the cover which will be detailed later. On the upper surface of the bottom 12, there are disposed along a longitudinal center plane, next to the recesses 121 at both ends, two symmetrical piers 14—14' with a recess 16 between. In a lateral center plane on the bottom 12, a couple of block piers 15—15' are oppositely disposed transversely with respect to the gap 16 between them.

Piers 15—15' are also integrally formed with the respective vertical walls 11, 13, while piers 14—14' are of odd shape having end face 141, top faces 142 which are discontinued with a groove 143 disposed in between two sections, the top face 142 being extended to an inclined surface 144, also longitudinal faces 145—145'. On the bottom 12, aligned with groove 143 of the pier 14, are horizontal rib sections 122—122(122'—122'), standing along the vertical wall 11, 13 and the respective vertical ribs 111—111', 131—131'.

The piers and ribs are provided to facilitate the connection of conductor (wires) to ensure the accuracy so that the conductors as connected would not be pulled apart from the connector upon subjecting to foreign forces.

Cover 20 serves to close up the open top of the tray-like body 10 of the connector. At each end on the undersurface of the cover plate 21, a hook like catcher 221 is extended downwardly corresponding to the position of the recess 121, so as to be gripped in it to assure a proper closure of the cover.

Disposed under the cover plate 21 there is also a pair of horizontal ribs 211—211' for the purpose of engaging the same into grooves 143—143' on the piers 14, so that the positions of the ribs and the grooves correspond.

Between the pair of ribs 211—211', there is a block 212 formed integrally under the cover plate 21. Having walls tapered downwardly, the block 212 is gripped tightly within the recess 16 surrounded by the piers 15—15' and 14—14'.

Figure 3:
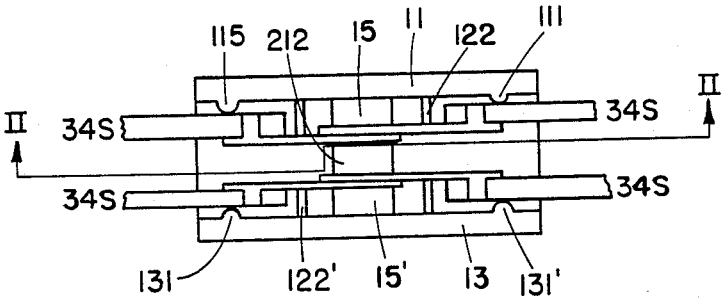
FIG. 3 is a top view of the embodiment with the cover off, of a two-wire systems.

Now referring to FIG. 2, this is a front view of the longitudinal section taken along line II—II in FIG. 3 which is a top view showing one of the applications. A metal terminal plate 31 with two projections 32—32' is disposed along two sides and a wrap-around connection piece 33 is provided to clamp a conductor 34 which may be constituted of a single wire 34S or a double wire 34D. The terminal plate 31 is led in through the open end of the U shaped tray body (in FIG. 2, the right-hand end) into the longitudinal channel within the body. Being inserted into the clearance between the wall 151 of the pier block 15 and the wall 145' of the pier 14, with the cover plate 21 in a closed position, the terminal plate 31 having its projection 32 abutting horizontal rib 211 under the cover plate 21 and projection 32' abutting horizontal rib 122 on the upper surface of the bottom 12, is not pulled out of the right end of the channel of the tray body.

The above clearance is designed to take at least two terminal plates, one entering from the right hand end as shown and the other from the left hand end (not shown in FIG. 2 for clarity). The terminal plate from the left hand is likewise prevented by the ribs 221 and 122' from being pulled out from right.

In FIG. 3 only one vertical rib 111 is shown which prevents the conductor wire 34 to shift laterally and to give dual assurance to the preciseness of the connection.

Figure 4:
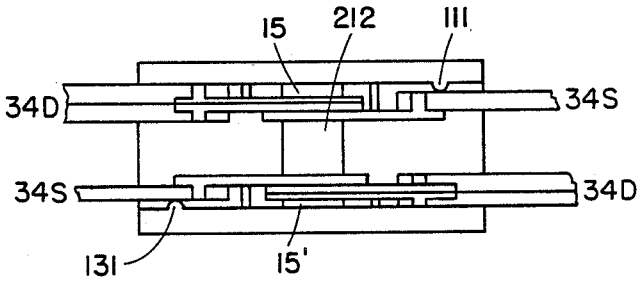
FIG. 4 is similar to FIG. 3, yet of a three-wire system with individual terminals.
Figure 5:
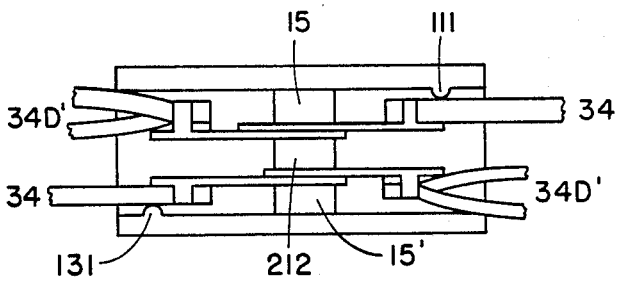
FIG. 5 is similar to FIG. 4, with a two-wire conductor sharing one terminal.

Rib 111 may also be omitted when the related conductor wire is of the 34D type (double wire with single terminal plate) since the double-wire would occupy sufficient space to be well fixed without rib 111, such as shown in enlarged top view of the open top connector in FIGS. 4 and 5, in which only ribs 111, 131 are disposed diagonally for those single wire conductors 34S—34S.

A top view of the embodiment as shown in FIG. 2 is schematically illustrated in FIG. 3, where single to single connection (referred to as two-wire system) of conductor pairs 34S—34S is applied, four vertical ribs 111—111', 131—131' are all provided.

In FIG. 4, a connection of pairs of single to double referred to as three wire system 34S—34D—34S is shown. In this embodiment, the double wire conductor 34D is composed of two single terminal wires with terminal plates placed back to back. Vertical ribs corresponding to where 34D is located are all omitted.

FIG. 5 is substantially the same as FIG. 4, except that the double wire conductor 34D' incorporates two wires into only one terminal plate.

Figure 7:
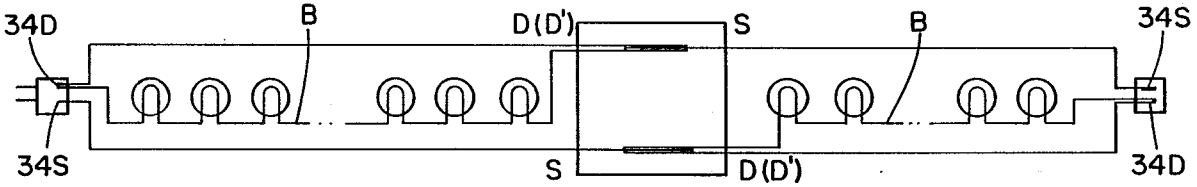
FIG. 7 is similar to FIG. 6 but with a two-wire system.
Figure 6:
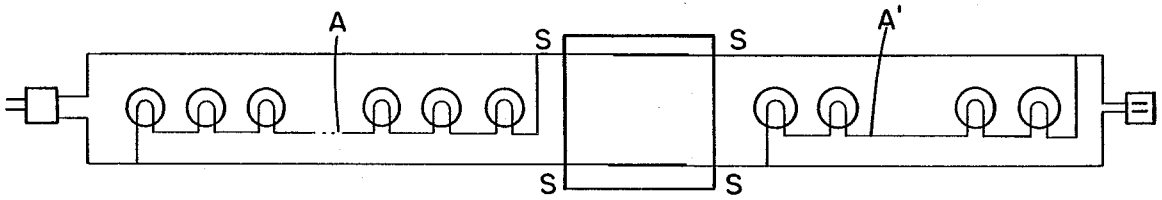
FIG. 6 is a schematic diagram showing the application to a three-wire system where two shorter strings of light B are connected into a longer one through a connection box according to the present invention.

FIGS. 6 and 7 show respectively the application in the connection of S type to S type and S to D (or D') type, with shorter strings, A, A' and B, B' to be connected. At the ends of the longer string A—A', B—B', adapter means such as plug or socket may be provided to facilitate possible extension.

The connection box aforesaid may be made of plastics material, and the terminals may be made of metal plate. It is to be understood that the description by way of a few embodiments serves only for illustration and not limitation. Without departing from the spirit and inventive concept of this application, those skilled in the art can see the scope to be extended to a system of more than three wires and the provision of the piers, blocks as well as ribs can be of forms modified from the present invention, and the shape is not limited to the rectangular ones as herein mentioned.

The present invention makes the in-situ connection of two shorter strings of decoration light into a longer string possible. The problems in packing and handling derived from the direct manufacturing of long strings are hereby eliminated.

I claim:

1. A connection box of plastic material for use in in-situ electrical connection of two short strings of decoration light into a longer string comprising:

an elongated tray of U-shaped cross-section having longitudinal walls, a floor, open ends and longitudinal channels for entry and passage of the conductors of the light strings, said tray having an open top;

a cover plate for the closure of said open top;

two metallic terminal plates passing through each open end of said tray for connection with said conductors;

said channels within the tray being formed by piers and blocks arranged on the floor of said tray, clearance therebetween being provided for the insertion of said terminal plates;

horizontal ribs (211, 211') disposed under said cover plate and on the floor of said tray (122, 122'7) for engagement with said terminal plates;

vertical ribs disposed along the inner longitudinal walls of said tray for tightly squeezing said conductors.

2. The connection box according to claim 1 wherein said tray has two blocks (15 and 15') disposed transversely with respect to the longitudinal walls (11, 13) and opposite to each other, two piers (14 and 14') located along the longitudinal central plane of said tray, said blocks (15 and 15') having inner vertical walls (151, 151'), said piers (14, 14') forming a clearance space (16) ,therebetween and having vertical walls (141, 141'), tops (142, 142'), grooves,(143, 143') in said tops, and longitudinal walls (145, 145'), said terminal plates being held in the channels formed between said inner vertical walls of said blocks disposed transversely with respect to the longitudinal walls of the tray (151, 151') and said longitudinal walls of said piers (145, 145') when said cover is in the closed position.

3. The connection box according to claim 2 wherein grooves on said piers engage with said horizontal ribs (211, 211') under the cover plate.

4. The connection box according to claim 3 wherein said terminal plates are of rectangular shape having projections (32, 32') on both sides, one projection abutting one of said horizontal ribs under the cover plate (211), the other projection abutting one of said horizontal rib (122) on the floor of the tray.

5. The connection box according to claim 1 wherein at both ends of the floor of said tray, recesses (121, 121') are provided and at the corresponding location under the cover plate, hook-like catchers (221, 221') are extended downwardly for insertion into said recesses to ensure the closure of the connection box.

6. The connection box according to claim 1 wherein said terminal plates are connected to a single conductor wire or double conductor wires, and the short elementary strings are connected and related to the final length in a parallel or series manner.

7. The connection box according to claim 1 which serves for the connection of two strings and other boxes are added in the n number, and the total number of strings is $n+1$, the strings are extended to a new length, the final length of the strings containing n boxes is $(n+1)$ elementary strings.

* * * * *